United States Patent [19]

Norton

[11] Patent Number: 4,982,522

[45] Date of Patent: Jan. 8, 1991

[54] GUN SAFETY LANYARD

[75] Inventor: Don S. Norton, Clinton, Miss.

[73] Assignee: Brell Mar Products, Inc., Jackson, Miss.

[21] Appl. No.: 492,917

[22] Filed: Mar. 13, 1990

[51] Int. Cl.[5] ..... F41C 23/02

[52] U.S. Cl. ..... 42/85; 42/90

[58] Field of Search ..... 224/150, 913, 908; 42/72, 85, 90

[56] References Cited

U.S. PATENT DOCUMENTS

| | | | |
|---|---|---|---|
| 2,536,252 | 1/1951 | Bates | 224/149 |
| 2,576,559 | 11/1951 | Bennek | 224/149 |
| 2,812,123 | 11/1957 | Girton | 224/150 |
| 3,522,766 | 8/1970 | Wolbarst | 354/85 |
| 4,249,686 | 2/1981 | Morwood | 224/150 |

FOREIGN PATENT DOCUMENTS

| | | | |
|---|---|---|---|
| 192826 | 12/1907 | Fed. Rep. of Germany | 42/85 |
| 226580 | 8/1909 | Fed. Rep. of Germany | 42/90 |

*Primary Examiner*—Charles T. Jordan
*Assistant Examiner*—Rochelle Lieberman
*Attorney, Agent, or Firm*—Nixon & Vanderhye

[57] ABSTRACT

Decreased risk of accidental gun discharge is provided by tethering a hunter'gun to the hunter via a gun safety lanyard of this invention. The gun safety lanyard generally includes a flexible cord having a preselected length and thereby establishing an opposing pair of looped ends. A first one of the looped ends of the flexible cord is attached to the handle grip of a gun's shoulder stock by means of a clove hitch, while a second one of the looped cord ends is positioned so as to encircle, for example, the wrist of the hunter's hand that will physically hold the hande grip of the gun's shoulder stock. A slide clasp is provided so as to adjust the relative size of the looped end that encircles the hunter's wrist. The lanyard may be stowed by simply positioning the second loop end in encircling relationship to the rear of the shoulder stock, and then adjusting the slide clasp to maintain the lanyard taunt against the exterior surface of the shoulder stock.

5 Claims, 3 Drawing Sheets

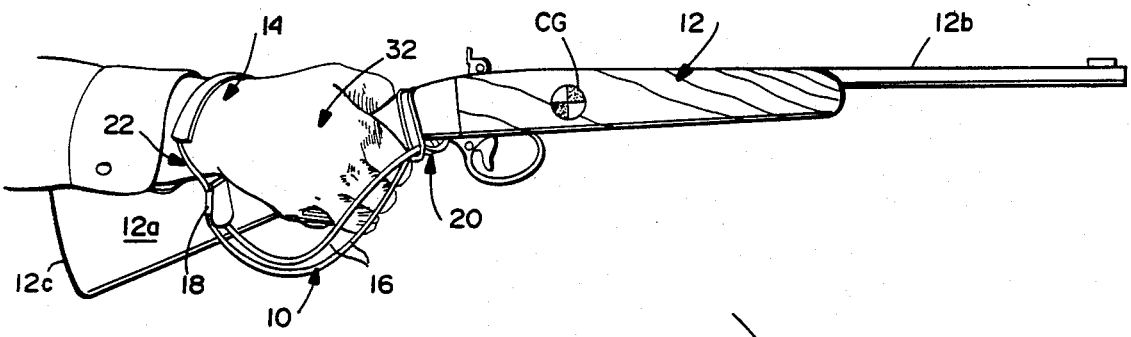
FIG. 4a
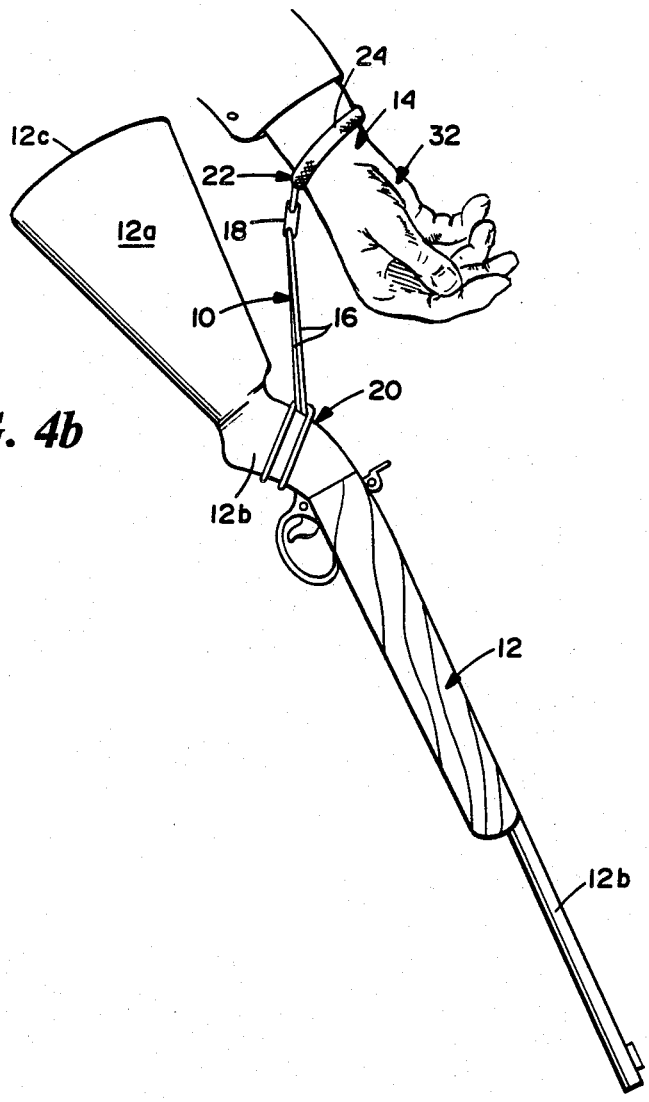
FIG. 4b
FIG. 5
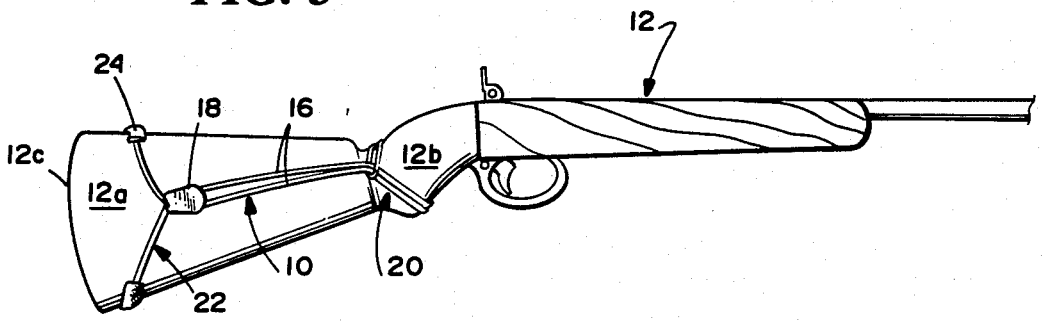

GUN SAFETY LANYARD

FIELD OF THE INVENTION

The present invention relates generally to the field of gun safety devices. More specifically, the invention relates to an especially adapted lanyard which tethers a gun to the hunter to prevent the gun from being dropped. In such a manner, the present invention significantly minimizes the risk of injury due to accidental gun discharge.

BACKGROUND AND SUMMARY OF THE INVENTION

Gun safety has been, and will continue to be, of significant importance to those that enjoy hunting pursuits. In this regard, one cause of injuries among hunters is the accidental discharge of guns when dropped. For example, hunters will sometimes position themselves in raised tree stands so as to obtain a better vantage point from which game may be observed. Obviously, should a hunter's gun drop to the ground when he or she is in a raised tree stand, it is quite likely that the gun will accidentally discharge upon impact and may thereby potentially wound the hunter. It is towards minimizing (if not preventing) such accidents that the present invention is directed.

According to the present invention, a gun safety lanyard is provided in the form of an endless loop of flexible cord having a preselected length and thereby establishing an opposing pair of looped ends. A first one of the looped ends of the flexible cord is attached to the handle grip of a gun's shoulder stock by means of a clove hitch, while a second one of the looped cord ends is positioned so as to encircle the wrist of the hunter's hand that will physically hold the handle grip of the gun's shoulder stock. The second looped cord end could, of course, encircle anything that is relatively stationary with respect to the hunter — i.e., the hunter's waist belt, web gear, or the like. For convenience of description, therefore, the hunter's wrist will be referred to hereinafter.

The relative size of the second looped cord end that encircles the hunter's wrist may be adjusted by means of a slide clasp. In such a manner, therefore, the gun safety lanyard of this invention may securely tether the gun to the hunter and thereby minimize accidental droppage (and the associated risk of gun discharge associated therewith).

During periods of nonuse, the gun safety lanyard of this invention may be stowed easily by merely removing the second looped cord end from the hunter's wrist, and then encircling the rear end of the gun's shoulder stock with the same, while keeping the first looped cord end attached to the handle grip of the stock. The slide clasp may thus be operated so as to reduce the size of the second looped end relative to the circumferential dimension of the shoulder stock which it encircles. As such, that portion of the cord between the two looped ends may be maintained in a taunt condition, and generally in an axial direction, against the exterior surface of the shoulder stock. By simply loosening this taunt condition — i.e., by increasing the size of the second looped cord end that encircles the rear end of the shoulder stock — the safety lanyard may again be placed into service by encircling the second looped end once again around a hunter's wrist.

Further advantages and aspects of this invention will become more clear after consideration is give to the following detailed description of the preferred exemplary embodiment.

BRIEF DESCRIPTION OF THE ACCOMPANYING DRAWINGS

Reference will hereinafter be made to the accompanying drawings wherein like reference numerals throughout the various FIGURES denote like structural elements, and wherein;

FIG. 1 is a view of a gun safety lanyard according to this invention during use;

FIGS. 2*a* and 2*b* collectively show the manner in which the gun safety lanyard may be attached to a gun's shoulder stock;

FIGS. 3*a* and 3*b* collectively show the manner in which the gun safety lanyard may be attached to a hunter, such as the hunter's wrist;

FIGS. 4*a* and 4*b* collectively show the manner in which the gun safety lanyard according to the present invention allows the gun barrel to fall downwardly away from the hunter when the hunter releases his or her grasp on the gun; and FIG. 5 is a side view of a gun particularly showing the gun safety lanyard according to the present invention in a stowed condition.

DETAILED DESCRIPTION OF THE PREFERRED EXEMPLARY EMBODIMENTS

Figure 1:
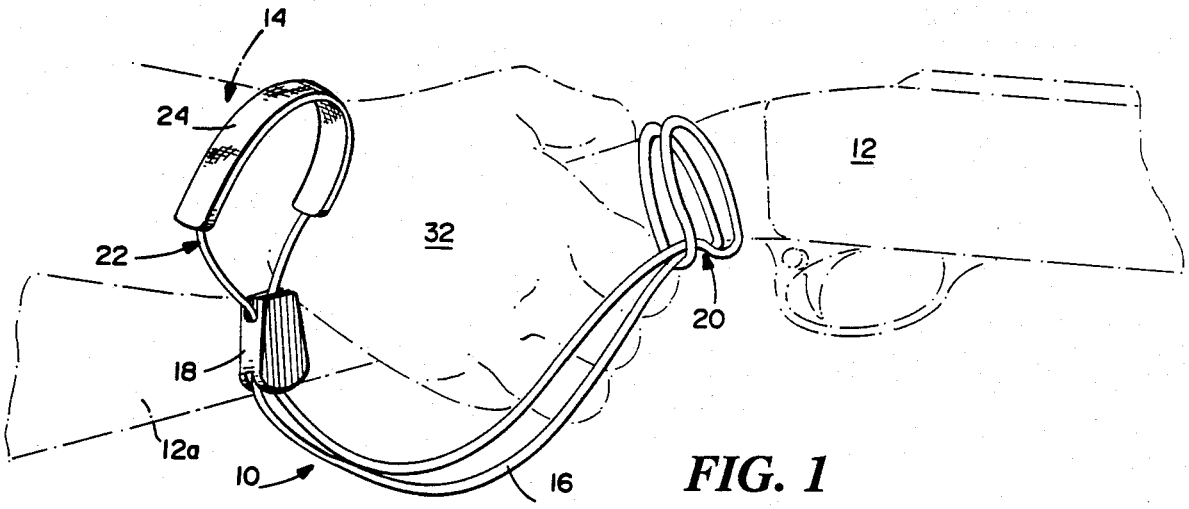

Accompanying FIG. 1 shows the gun safety lanyard 10 according to the present invention during use so as to tether a hunter's gun 12 to a portion of the hunter's body or clothing. For example, in FIG. 1, the lanyard 10 according to the present invention is depicted as tethering the gun 12 to a hunter's wrist 14.

The lanyard 10 according to the present invention is generally comprised of an endless loop of flexible cord 16 having a slide clasp 18 which, in essence, establishes first and second cord sub-loops at each of the cord's 16 end portions 20, 22, respectively. The first sub-loop at end 20 is attached to the handle portion 12*b* of the gun's shoulder stock 12*a*, whereas the second sub-loop at the end 22 is coupled to the hunter by encircling the hunter's wrist 14.

As will be explained in greater detail below, the slide clasp 18 may be adjustably moved along the length of the cord between its ends 20 and 22 so as to responsively adjust the effective size of the second sub-loop at end 22 to thereby allow it to be removed from the hunter's wrist 14 or to be drawn against the hunter's writs 14 to achieve a snug fit. In this regard, the second sub-loop at end 22 also preferably includes a fabric (or other) band 24 so as to provide improved comfort to the hunter when the sub-loop at end 22 encircles his or her wrist 14. The band 14 may be padded for additional comfort and/or be formed of a suitable elastomeric material as may be desired.

In order to place the lanyard 10 into service, it is necessary to first attach end 20 lanyard 10 to the gun's shoulder stock 12*a* (preferably the stock's hand grip 12 *b* ), and then to attach the other end 22 of the lanyard 10 to the hunter (e.g., the hunter's wrist 14) or to an article of the hunter's clothing (e.g., the hunter's web gear).

Figure 2A:
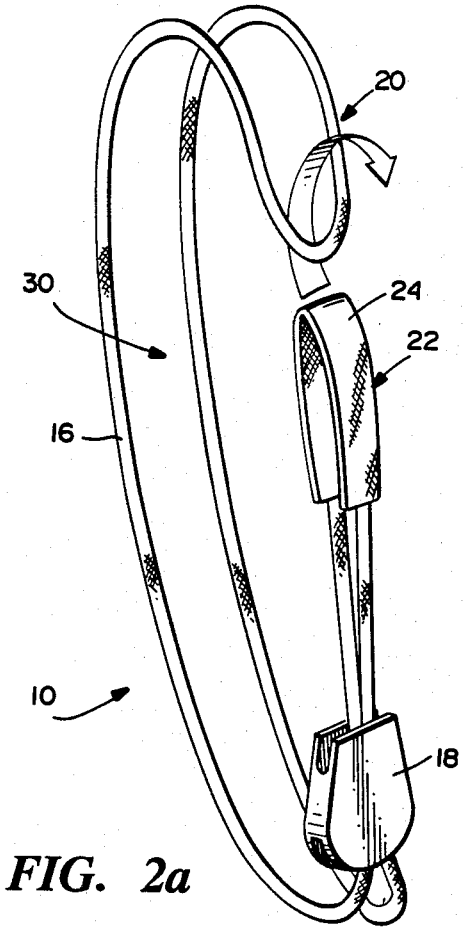
Figure 2B:
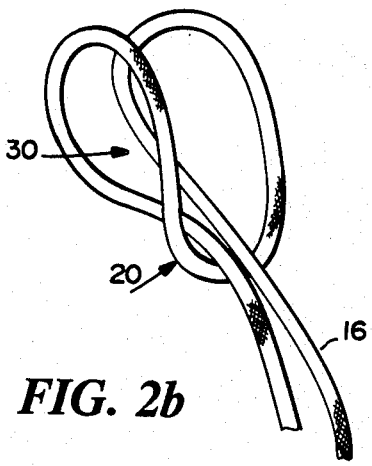

In order to attach the end 20 to the shoulder stock 12*a*, a clove hitch is formed in the manner to be described with reference to accompanying FIGURES 2*a* and 2*b*. In this regard, the end 22 is brought up and through the looped cord end 20 in the manner depicted by the arrow in FIG. 2*a*. The resulting configuration will establish an open interior loop 30 through which the shoulder stock 12*a* of the gun 12 may be placed. Of course, if the lanyard is not of sufficient length so as to form an interior loop 30 of a size adequate to accept the widest portion of the shoulder stock 12*a* (i.e., its rear end), the cord 16 may in the first instance simply be encircled around the grip of the shoulder stock such that the end 22 could then be passed through the end 20. Thus, although the shoulder stock 12*a* is not shown in FIGS. 2*a* and 2*b*, it will be understood that that was done simply to clarify the presentation of this invention.

Figure 3A:
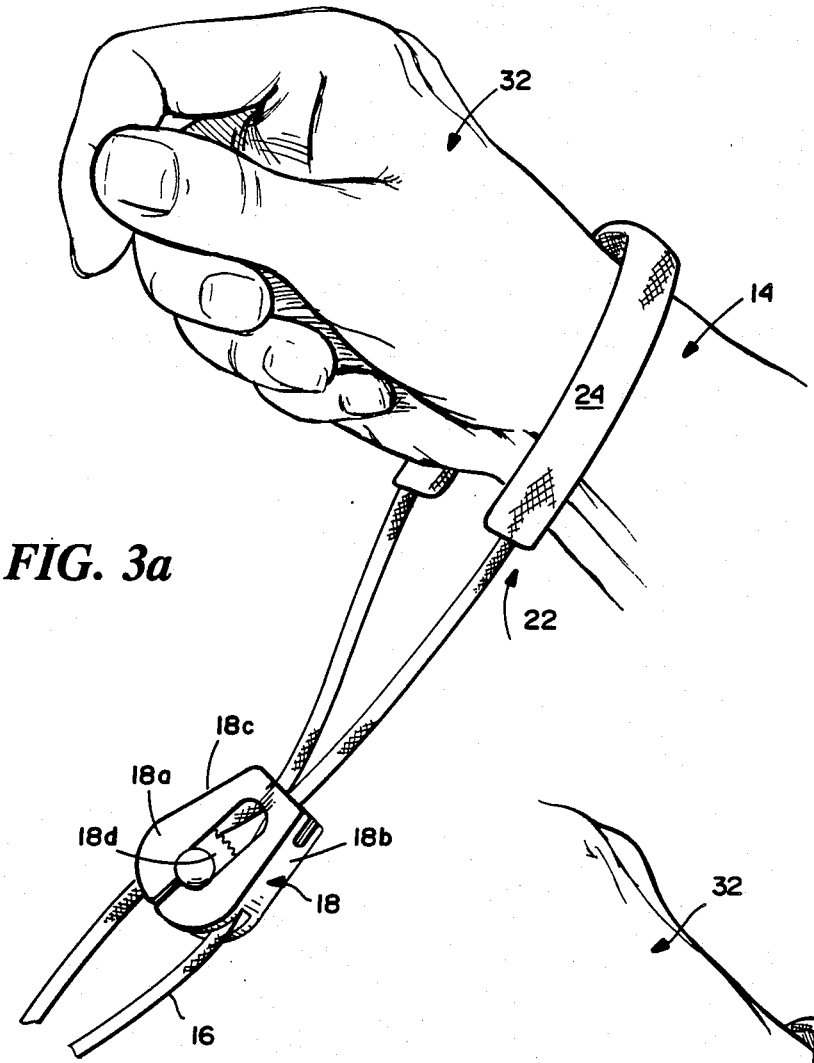

Once the end 20 has been attached to the shoulder stock 12*a* of gun 12 via a clove hitch configuration, the hunter simply encircles his or her wrist 14 with the other end 22 of the lanyard 10 as shown specifically in FIG. 3*a*. It will be noted that the slide clasp 18 is positioned along the length of the cord 16 such that the sub-loop formed at end 22 is of sufficient size so as to enable the hunter's hand 32 to easily be passed therethrough. With the looped end 22 encircling the hunter's wrist 14, the slide clasp 18 may then be moved towards the hunter's wrist 14 so as to decrease the size of the loop at end 22, and thereby provided a snug fit as shown in FIG. 3*b*.

Figure 3B:
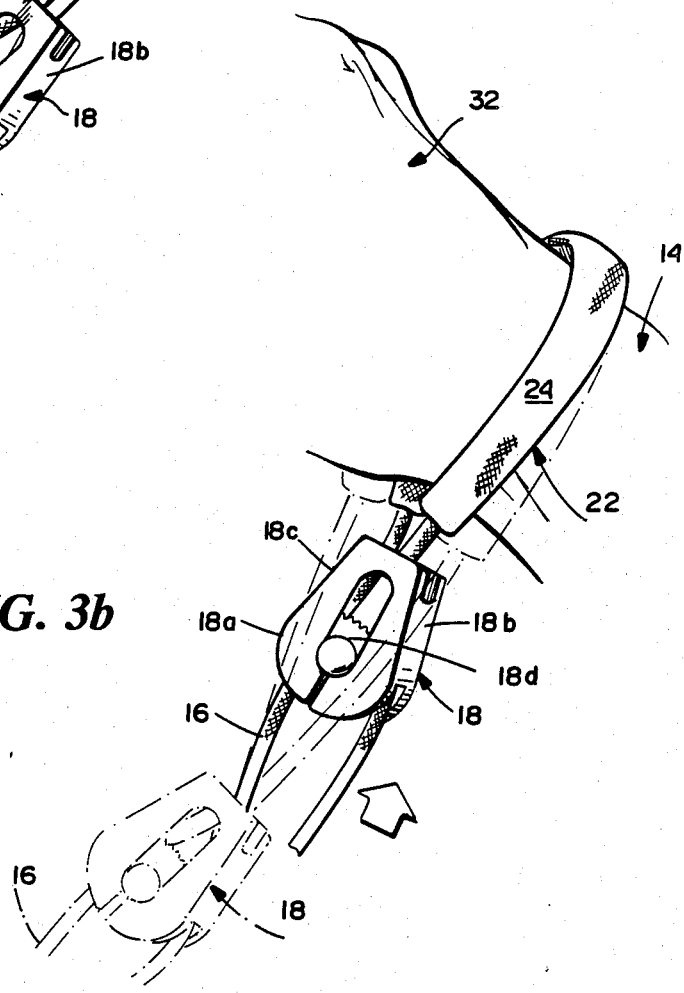

The slide clasp 18 is, in and of itself, conventional and includes a clasp body 18*a* defining an interior space through which opposing portions of the looped cord 16 extend, as is perhaps most clearly shown in FIGS. 3*a* and 3*b* . The clasp body 18*a*, moreover, includes a converging pair of opposing sidewalls 18*b*, 18*c*, and a knurled clasp wheel 18*d*. The clasp wheel 18*d* is operatively positioned within the interior space defined by body 18*a*, and moreover, is allowed to move longitudinally therewithin. It will be appreciated that when the clasp wheel 18*d* is moved within the clasp body 18*a* so that the former is located near the clasp body's upper end (as viewed in FIGS. 3*a* and 3*b*), it will capture opposing portions of the cord 16 therebetween due to the converging relationship of sidewalls 18*a* and 18*b*. On the other hand, when the clasp wheel 18*d* is located near the lower end of the clasp body 18*a* (as viewed in FIGS. 3*a* and 3*b*), sufficient clearance space exists to allow the cord to freely between the clasp wheel 18*d* and the interior of the clasp body 18*a*.

Therefore, when the clasp 18 is moves as a unit towards the hunter's wrist 14 (as shown by the arrow in FIG. 3*b*), the clasp wheel 18*d* will be located toward the lower end of the clasp body 18*a*. However, should the clasp body be moved away from the hunter's wrist (i.e., a direction opposite to the arrow in FIG. 3*b*), relative movement will be effected as between the clasp wheel 18*d* and the clasp body 18 causing the wheel 18*d* to capture the cord 16 and thereby maintain the snug fit around the hunter's wrist that was established. To loosen that fit, the wheel 18*d* simply need to be forcibly moved towards the lower end of the clasp body 18*a* so as to allow the cord 16 to freely pass therethrough as was described above.

As is shown in FIGS. 4*a* and 4*b*, since the lanyard 10 is attached to the gun 12 rearwardly of the gun's center of gravity CG (i.e., via the looped end 20 being attached to the hand grip portion 12*b* of the gun's shoulder stock 12*a*), in the event that the hunter should lose his or her grip upon the gun 12, the barrel 12*b* will fall downwardly away from the hunter's body. This is advantageous in at least two respects. First, since the gun 12 is tethered physically to the hunter's wrist 14 via the lanyard 10 of this invention, the gun 12 will not drop onto the ground. As such the risk of accidental discharge due to the gun dropping upon the ground is significantly minimized. Secondly, the gun's barrel 12*b* will responsively drop to the safest position — i.e., away from the hunter — automatically under the influence of gravity. Thus, even should the gun discharge, minimal risk of harm to the hunter is present since the barrel is physically pointed away from the hunter.

Accompanying FIG. 5 shows the gun safety lanyard 10 of the present invention in a stowed position. As shown, the end 22 of cord 16 (once it is removed from the hunter's wrist 14) is simply positioned so that it encircles the rear end of the shoulder stock 12*a* forwardly of the shoulder stock's butt end 12*c*, while keeping the end 20 of cord 16 attached to the handle grip 12*b* of stock 12*a* in a clove hitch configuration. Thereafter, any "slack" in the cord 16 may be removed by moving the slide clasp 18 rearwardly (relative to the shoulder stock 12*a*) so as to decrease the size of the looped end 22 and thereby maintain the cord 16 taunt against the shoulder stock 12*a*.

As can now be appreciated, the gun safety lanyard of the present inventions provides a means by which the risk of injury due to accidental gun discharge may be significantly minimized.

However, while the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. The combination comprising (1) a gun which includes a gun barrel and a shoulder stock, said shoulder stock having a butt end and a hand grip forwardly of said butt end and (2) a gun safety lanyard operatively associated with said shoulder stock, wherein said gun safety lanyard includes;

an endless loop of flexible cord having a preselected length; and slide clasp means operatively associated with said endless loop of flexible cord for establishing first and second opposing sub-loops, wherein said first sub-loop encircles a rearward portion of said shoulder stock forwardly of said butt end thereof, and said second sub-loop encircles said hand grip of said shoulder stock forwardly of said rearward portion of said shoulder stock such that said preselected length of said flexible cord is substantially taunt between said rearward portion and said hand grip of said shoulder stock to thereby retain said gun safety lanyard in a stowed condition relative to said shoulder stock, and wherein said slide clasp means is slidably movable along the length of said flexible cord to increase the size of said first sub-loop to allow said first sub-loop to be removed from said rearward portion of said gun stock and to thereby allow said first sub-loop to be attached to a hunter, whereby the gun may be tethered to the hunter so as to minimize droppage of the same and thereby provide a measure of increased safety against accidental gun discharge.

2. The combination as in claim 1, wherein said second sub-loop encircles said hand grip in the form of a clove hitch configuration.

3. The combination as in claim 1, wherein said slide clasp means includes loop adjustment means for effecting size adjustment of at least one of said established sub-loops.

4. The combination as in claim 1, wherein said established first sub-loop includes a wrist band for improving comfort to the hunter during use.

5. A gun safety lanyard as in claim 3, wherein said loop adjustment means includes a slide clasp mechanism, said slide clasp mechanism including a clasp body which defines an interior space in which a portion of said flexible cord is positioned, and clasp means also positioned in said interior space and movable between (i) a first position in which said clasp means captures said portion of said flexible cord against said clasp body whereby said clasp mechanism is prevented from moving along the length of said flexible cord, and (ii) a second position in which said clasp means is spaced from said portion of said flexible cord whereby said clasp mechanism is allowed to be moved along the length of said flexible cord and thereby adjust the size of at least one of said established sub-loops.

* * * * *